United States Patent [19]

Piretti

[11] Patent Number: 4,796,952

[45] Date of Patent: Jan. 10, 1989

[54] CHAIR WITH HINGED BACKREST

[76] Inventor: Giancarlo Piretti, Piazza Trento e Trieste 2/2, Bologna, Italy

[21] Appl. No.: 50,862

[22] Filed: May 18, 1987

[30] Foreign Application Priority Data

Jun. 12, 1986 [IT] Italy ..... 53523/86[U]

[51] Int. Cl.[4] ..... A47C 3/20

[52] U.S. Cl. ..... 297/340; 297/300; 297/316

[58] Field of Search ..... 297/300, 316, 320, 321, 297/340, 341; 248/157, 421

[56] References Cited

U.S. PATENT DOCUMENTS

| | | | |
|---|---|---|---|
| 142,039 | 8/1873 | Niderkorn . | |
| 251,396 | 12/1881 | Wilson . | |
| 302,672 | 7/1884 | Sargent et al. . | |
| 799,128 | 9/1905 | Wilmot et al. | 297/316 X |
| 847,880 | 3/1907 | Barker et al. . | |
| 1,001,610 | 8/1911 | Blaylock . | |
| 1,045,599 | 11/1912 | Osterdorf . | |
| 1,149,421 | 8/1915 | Wilmot . | |
| 1,335,379 | 3/1920 | Lee . | |
| 1,604,001 | 10/1926 | Vetchik . | |
| 1,619,503 | 3/1927 | Furlong . | |
| 1,902,586 | 3/1933 | Santos . | |
| 2,083,838 | 6/1937 | Goenen . | |
| 2,365,200 | 12/1944 | Lorenz . | |
| 2,470,364 | 5/1949 | Niederhauser . | |
| 2,471,024 | 5/1949 | Cramer . | |
| 2,535,687 | 12/1950 | Lorenz . | |
| 2,579,502 | 12/1961 | Lorenz . | |
| 2,615,496 | 10/1952 | Lorenz et al. . | |
| 2,616,483 | 11/1952 | Jensen . | |
| 2,627,898 | 2/1953 | Jackson . | |
| 2,628,663 | 2/1953 | Jensen . | |
| 2,764,224 | 9/1956 | Maurer | 297/316 X |
| 2,778,408 | 1/1957 | Krikorian . | |
| 2,859,799 | 11/1958 | Moore . | |
| 2,859,801 | 11/1958 | Moore . | |
| 3,005,660 | 10/1961 | Winick . | |
| 3,139,305 | 6/1964 | Mizelle | 297/321 X |
| 3,330,595 | 7/1967 | Svard . | |
| 3,402,964 | 9/1968 | Williams . | |
| 3,416,839 | 12/1968 | Flint . | |
| 3,489,459 | 1/1970 | Katan, Sr. et al. . | |
| 3,578,379 | 5/1971 | Taylor et al. . | |
| 3,602,537 | 8/1971 | Kerstholt . | |
| 3,603,640 | 9/1971 | Doerner . | |
| 3,603,641 | 9/1969 | Kasbusch . | |
| 3,869,172 | 3/1975 | James et al. . | |
| 3,913,975 | 10/1975 | Carter . | |
| 3,989,297 | 11/1976 | Kerstholt . | |
| 4,200,332 | 4/1980 | Brauning . | |
| 4,270,797 | 6/1981 | Brauning . | |
| 4,314,728 | 2/1982 | Falks . | |
| 4,362,335 | 12/1982 | Drabert et al. . | |
| 4,364,605 | 12/1982 | Meiller . | |
| 4,410,213 | 10/1983 | Samson . | |
| 4,411,469 | 10/1983 | Drabert et al. . | |
| 4,429,917 | 2/1984 | Diffrient . | |
| 4,432,582 | 2/1984 | Wiesmann et al. . | |
| 4,451,085 | 5/1984 | Franck et al. . | |
| 4,471,994 | 9/1984 | Zund et al. . | |
| 4,478,454 | 10/1984 | Falks . | |
| 4,479,679 | 10/1984 | Fries et al. | 297/300 |
| 4,502,729 | 3/1985 | Locher . | |
| 4,505,514 | 3/1985 | Stocki et al. . | |
| 4,537,445 | 8/1985 | Neuhoff . | |
| 4,575,150 | 3/1986 | Smith . | |
| 4,595,236 | 6/1986 | Rizzoli . | |
| 4,636,002 | 1/1987 | Genjiro | 297/321 X |

FOREIGN PATENT DOCUMENTS

| | | |
|---|---|---|
| 2045120 | 2/1971 | France . |

*Primary Examiner*—Kenneth J. Dorner
*Assistant Examiner*—Peter R. Brown
*Attorney, Agent, or Firm*—Fuller, Puerner & Hohenfeldt, S.C.

[57] ABSTRACT

The chair is provided with a seat connected to a support structure of the chair by means of one or more hinged parallelograms consisting of pairs of tie-rods hinged to the seat and to the support structure. The structure of the chair backrest is integral with at least one of the tie-rods so as to allow the seat to be raised when the backrest is pushed backwards. Provision is also made for elastic means which are designed to counteract the backwards movement of the backrest.

13 Claims, 3 Drawing Sheets

CHAIR WITH HINGED BACKREST

BACKGROUND OF THE INVENTION

1. Field of the Invention.

The present invention relates to a chair comprising a support structure and a seat connected to the support structure by means of an adjustable parallelogram system that includes members in the form of levers. The first ends of the levers are hinged to the seat, and the second ends of the levers are hinged to the support structure such that the seat is able to move between a lowered position and a raised position. A backrest is hinged to the support structure and is operationally connected to the seat so as to be able to pivot between an upright position corresponding to the lowered position of the seat and a reclined position corresponding to the raised position of the seat.

2. Description of the Prior Art

French Pat. No. 2,045,120 discloses a chair having a parallelogram system for pivotally supporting a seat on a support structure. The backrest is pivoted to the support structure by a lever that is not part of the seat supporting parallelogram system. Reclining the backrest causes the lever to force the back edge of the seat upwardly and backwardly relative to the support structure. The chair of the aforementioned patent allows the backrest to exert on the back of the user a force proportional to his weight. However, the structure of the chair of the French patent is somewhat complicated. Moreover, the design of the adjustable parallelogram system associated with the mechanism for controlling displacement of the seat by the backrest requires excessive space.

SUMMARY OF THE INVENTION

The air of the present invention is to provide a chair equipped with a seat/backrest connecting system which is particularly simple and compact, and which does not possess the drawbacks of the solutions previously adopted.

According to the invention, this aim is achieved by designing the backrest to be integral with one of the levers, and by providing elastic means which are associated with the adjustable parallelogram system and designed to hold the backrest elastically in the upright position.

As a result of the above mentioned characteristic features, the adjustable parallelogram system has particularly small dimensions, allowing it to be used even in so-called stackable chairs. Furthermore, because of the compactness of the backrest/seat connecting system, it is possible to obtain a chair which is both aesthetic and offers the same features as a chair or arm chair which is considerably more complex, costly, and larger in size.

Preferably, in the chair according to the invention, at least one of the levers has, on the end that is hinged to the support structure, an arm such that the arm defines, together with the lever itself, a first right angle lever that is pivotally mounted on the support structure, with the elastic means being inserted between the arm and the support structure.

Further characteristic features and advantages of the chair according to the invention will emerge from the detailed description provided by way of a non-limited example.

DETAILED DESCRIPTION OF THE INVENTION

Figure 1:
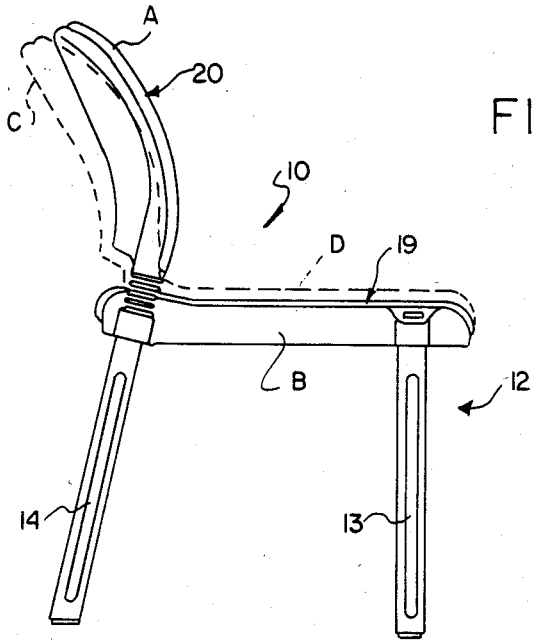
FIG. 1 is a side view of a chair according to the invention.
Figure 2:
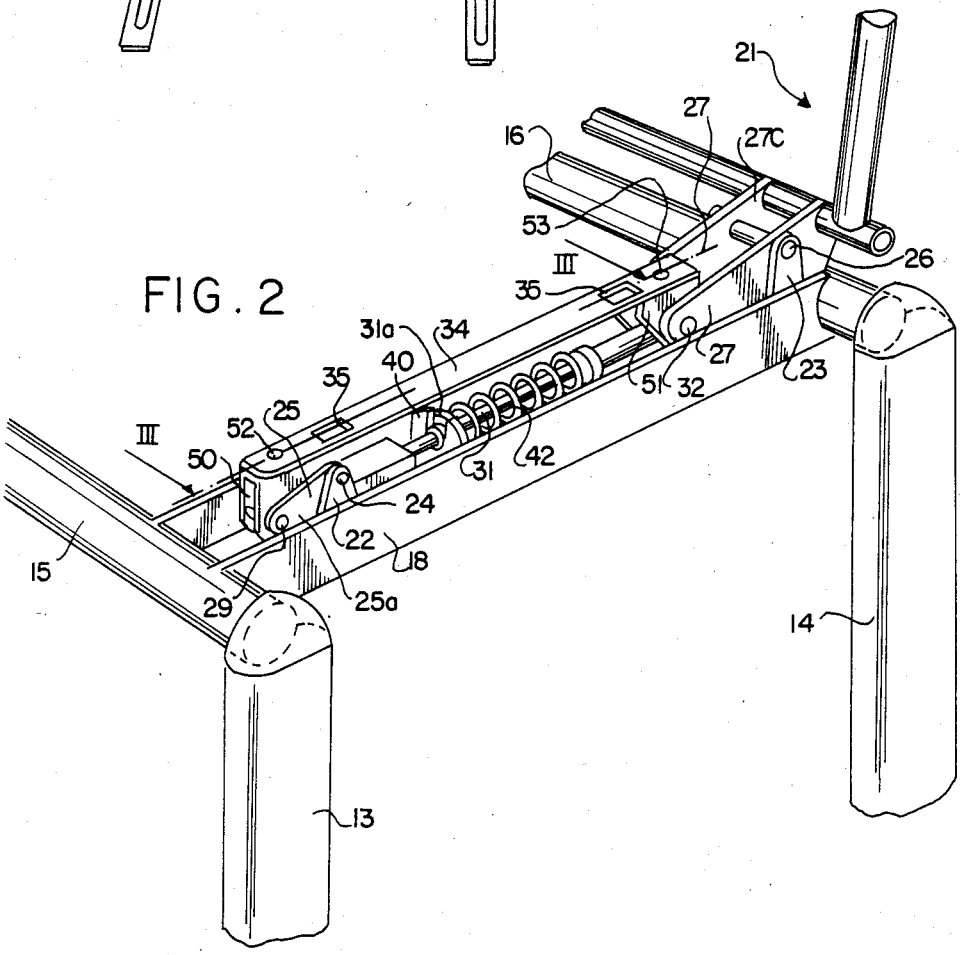
FIG. 2 is a perspective view showing the adjustable parallelogram system.

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

With reference to the drawings, numeral 10 denotes in its entirety a chair of the stackable type. The chair 10 comprises a support structure 12 that includes front legs 13, rear legs 14, a front tubular cross-piece 15 joining the front legs 13 at the tops thereof, and a rear tubular cross-piece 16 joining the rear legs 14 at the tops thereof. A pair of U-shaped longitudinal braces 18 join the front cross-piece 15 and the rear cross-piece 16.

The chair 10 also has a seat 19 and a backrest 20. The backrest 20 is provided with an internal structure including metal tubes 21.

Each brace 18 has, at the front, a first pair of lugs 22, and at the rear, a second pair of lugs 23 adjacent the rear cross-piece 16 of the chair 10. A first pair of right-angled levers 25 is hinged at 24 to the first pair of lugs 22. A second pair of right-angled levers 27 is hinged at 26 to the second pair of lugs 23. Each first right-angled lever 25 has a first end **25*a* hinged at 29 to the seat 19 and a second end 25*b* hinged at 30 to a metal rod 31**.

In exactly the same way, each right-angled lever 27 has a first end **27*a* hinged at 32 to the seat 19 and a second end 27*b* hinged at 33 to the metal rod 31. The first ends 25*a* and 27*a* of the first and second right-angle levers 25 and 27, respectively, are hinged to the seat 19 by inserting U-shaped metal members 50 and 51 between the pairs of levers 25 and 27, respectively. The bases of the U-shaped members 50 and 51 are fixed at 52 and 53 to the ends of a metal bar 34. The bar 34 has openings 35 for connecting it, by means of screws 36, to the seat 19**.

Each right-angle lever 27 has, in the vicinity of the point 26 where it is hinged to the longitudinal brace 18, a portion **27*c* which is welded to the metal structure 21 of the backrest 20. Each lever 27 also has a stop portion 27*d* located in the vicinity of the end 27*b*. The stop portion 27*d* is designed to abut against the bottom wall of the brace 18**.

The rod 31, which is hinged to the second ends **25*b* and 27*b* of the right-angled levers 25 and 27, respectively, has an annular shoulder 31*a* facing a projection 40 which is substantially fork-shaped and integral with the walls of the longitudinal brace 18. The rod 31 is slidably mounted inside the projection 40. Between the projection 40 and the annular shoulder 31*a* is located a helical spring 42 which is coaxial with the rod 31. The mode of operation of the spring 42** will be explained below.

Figure 3:
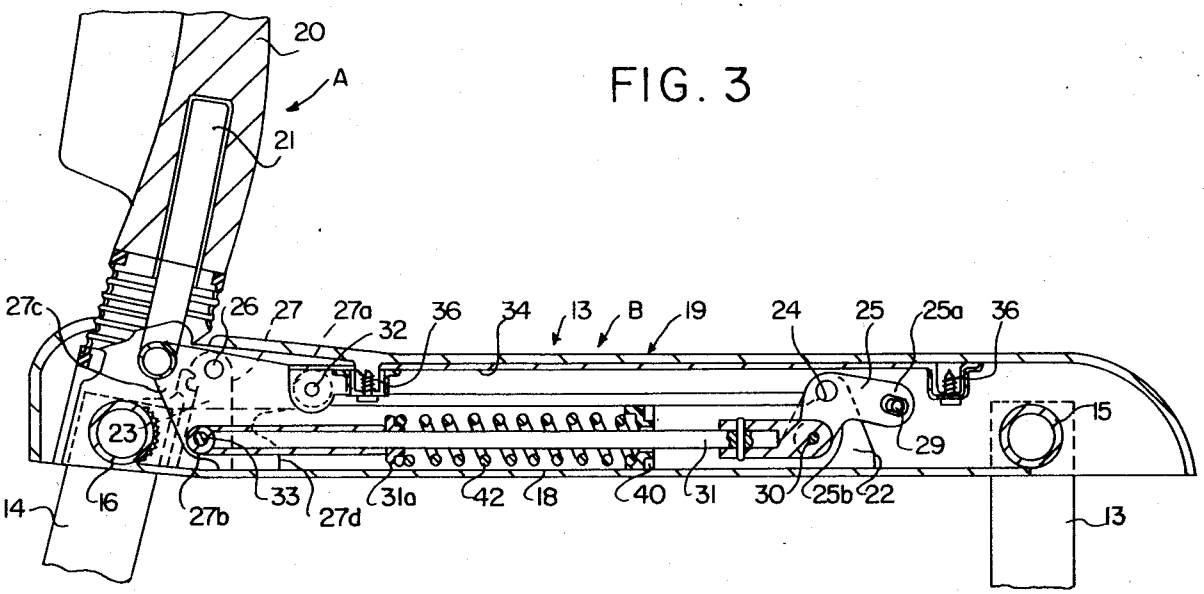
FIG. 3 is a cross sectional view taken along the line III—III of FIG. 2, showing the configuration when the seat is lowered.
Figure 5:
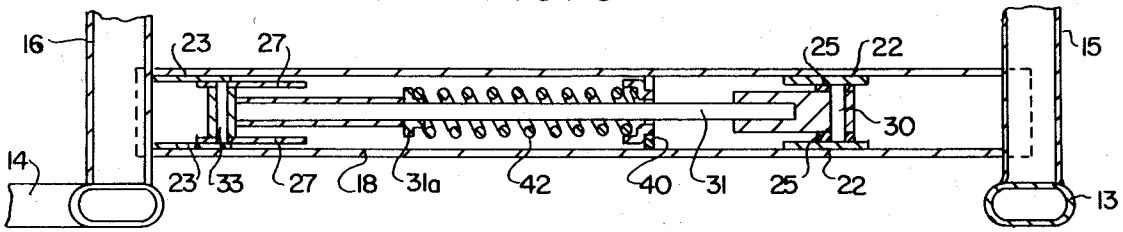
FIG. 5 is a cross sectional view taken along line V—V of FIG. 4.

FIG. 3 shows the "rest" condition of the chair wherein the backrest 20 assumes an upright position indicated by A. In this condition, the spring 42 acts on the adjustable parallelogram comprised of the longitudinal brace 18, the seat 19, and the arms of the levers 25 and 27 located between the hinge points 24 and 29 and the hinge points 26 and 32, respectively, so as to keep the seat 19 in the lowered position, indicated by B, wherein the stop portions **27*d* of the levers 27 are in contact with the respective braces 18**.

Figure 4:
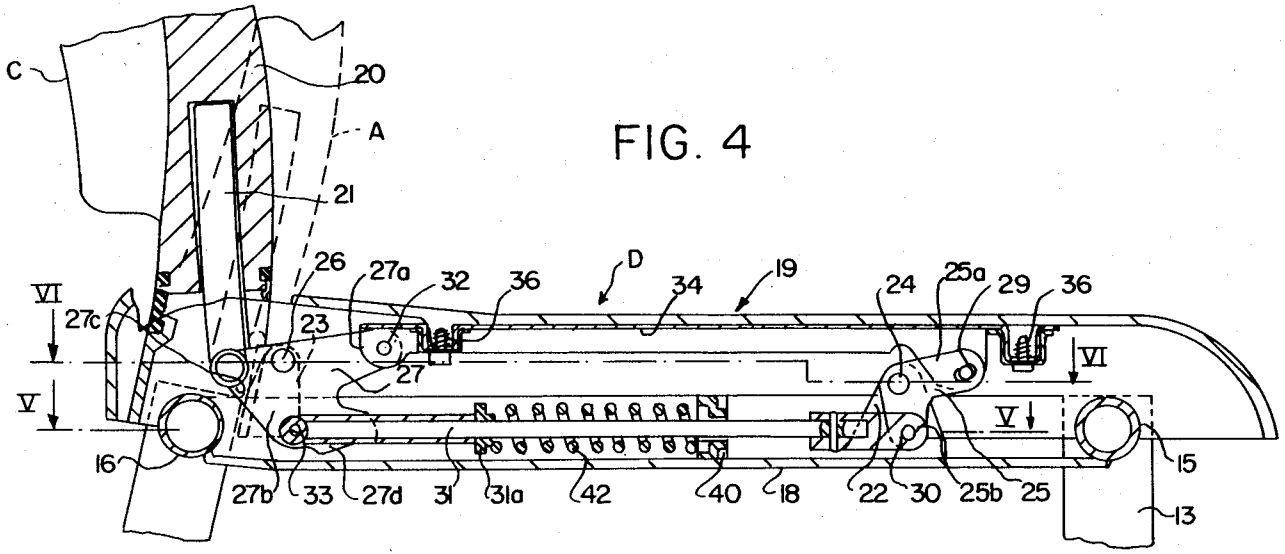
FIG. 4 is a view similar to FIG. 3, but showing the seat in the raised position.
Figure 6:
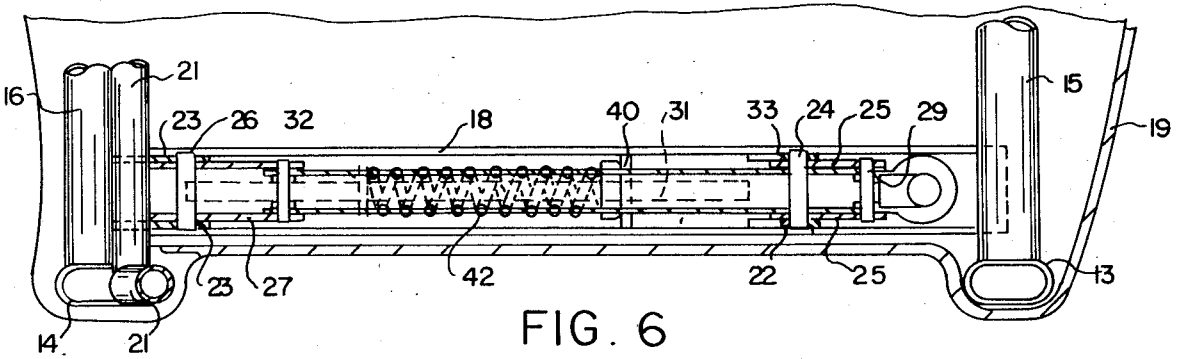
FIG. 6 is a cross sectional view taken along line VI—VI of FIG. 4.

In the operative condition, i.e., when the user presses with his/her back against the backrest 20, the latter pivots backwards into a reclined stable position, indicated by C. At the same time, because of the metal structure 21 being fixed to the second right-angled levers 27, the seat 19 is raised, due to the rotation of the right-angled levers 25 and 27 about their respective fulcrums 24 and 26, until the stable condition indicated by D in the drawings is reached. This stable condition is shown in detail in FIG. 4. Because of the parallelogram system for supporting the seat, the plane of the seat in the raised condition D is substantially parallel to the plane of the seat in the lowered condition B.

In the stable condition C, the backrest 20 exerts on the back of the user a force proportional to the weight of the user, further increased by the force due to the helical spring 42. In this way, it is possible to minimize the dimensions of the levers 25 and 27 and hence the entire adjustable parallelogram system, thereby ensuring reliable and comfortable operation for the user.

The present invention is intended to be applicable to all devices which perform the same functions, using the same innovative idea. For example, the seat/backrest connecting system may be advantageously used for any type of chair or arm chair.

I claim:

1. A chair comprising a support structure; a seat connected to the support structure by means of a pair of first and second levers having respective first ends hinged to the seat and respective second ends hinged to the support structure, so that the support structure, first and second levers, and seat define a parallelogram system that is able to move the seat between a lowered position and a raised position; and a backrest hinged to the support structure and operationally connected to the seat so as to be able to pivot between an upright position corresponding to the lowered position of the seat and a reclined position corresponding to the raised position of the seat, characterized in that:

a. the backrest (20) is integral with at least one of the second levers (27);

b. elastic means (42) are associated with the parallelogram system (18, 19, 25, 27) and are designed to hold the backrest (20) elastically in the upright position (A);

c. at least one of the levers (27) has, on the end hinged to the support structure (12), an arm (**27*b*) such that the arm defines with the lever (27) a right-angled lever pivotally mounted on the support structure (12), the elastic means (42) being inserted between the arm (27*b*) and the support structure (12**);

d. a rod (31) is hinged to the arm (**27*b*) of the right-angled lever, which rod is provided with an annular shoulder (31*a*) facing an associated projection (40) integral with the support structure (12), the elastic means comprises a helical spring (42) coaxial with the rod (31) being arranged between the shoulder (31*a*) and the projection (40**) to render the parallelogram system adjustable.

2. The chair according to claim 1, characterized in that each lever of the adjustable parallelogram system comprises an arm to form first and second right-angled levers (25, 27), to the respective arms (**25*b*, 27*b*) of the right-angled levers the ends of the rod (31**) are hinged.

3. The chair according to claim 1 or claim 2 in which the support structure (12) comprises a pair of longitudinal braces (18) in the vicinity of the seat (19), and characterized in that:

a. the pairs of first and second levers comprise a first pair (25) and a second pair (27) of right-angled levers hinged on the braces (18), the second pair of right-angled levers being hinged close to the backrest (20);

b. the backrest (20) includes an internal tubular structure (21);

c. the second pair of levers are provided with portions (**27*c***) to which the backrest internal structure is fixed;

d. each lever of the first and second pairs of right-angled levers has a respective first arm (**25*a*, 27*a*) hinged to the seat (19) and a respective second arm (25*b*, 27*b***); and e. the rid is hinged to the second arms of the respective levers.

4. The chair according to claim 3, characterized in that the longitudinal braces (18) comprise U-shaped metal sections inside which the rods (31) and the helical springs (42) are contained.

5. The chair of claim 4 characterized in that:

a. the rod comprises a center section and two end sections;

b. the annular shoulder is formed on the rod center section;

c. the support structure projection is fabricated with a fork shape that defines a space adapted to accept the rod center section for reciprocation within the forked space; and d. the helical spring is coaxial with the rod center section.

6. The chair according to claim 5 characterized in that the rod end sections are hinged to the second arms of the respective right angled levers at locations proximate the longitudinal braces (18) to thereby enable the parallelogram system to achieve a low vertical profile.

7. A chair comprising:

a support structure, a seat, at least one front and one rear lever having respective opposed ends that are pivotally connected to the support structure and the seat, respectively, so as to define with the seat and support structure a parallelogram linkage connecting the seat to the support structure and allowing the seat to be moved between a lowered position and a raised position, a backrest support structure which is rigidly and non-pivotally connected to said rear lever so as to be movable together with said rear lever between an upright position corresponding to the lowered position of the seat and the reclined position corresponding to the raised position of the seat, and spring means associated with at least one of said front and rear levers for biasing the backrest support structure towards its upright position corresponding to the lowered position of the seat.

8. A chair as set forth in claim 7 wherein at least one of said front and rear levers includes an arm, said spring means being interposed between said arm and the support structure.

9. A chair as set forth in claim 8 wherein a rod is hinged to said arm, said rod being provided with a shoulder facing an associated projection integral with the support structure, and wherein a helical spring coaxial with the rod is arranged between the shoulder and the projection.

10. A chair as set forth in claim 9 wherein each of said front and rear levers includes a respective arm, said rod having its ends pivotally connected to said respective arms.

11. A chair as set forth in claim 10 wherein the support structure includes a pair of longitudinal side braces adjacent the seat, each of said braces pivotally supporting a front and a rear pair of right-angled levers adjacent the front and the rear ends of the longitudinal brace, respectively, each right-angled lever including a first portion constituting the respective front and rear levers and a second portion constituting the associated arm, the right-angled levers of the rear pair further including portions that are rigidly fixed to the backrest support structure.

12. A chair as set forth in claim 11 wherein said longitudinal braces comprise U-shaped sections wherein said rod and said spring means are located.

13. A chair as set forth in claim 12 wherein the seat is provided with two longitudinal bars, each bar having two inverted U-shaped brackets rigidly fixed to the front and the rear ends thereof, each bracket being pivotally connected to a corresponding pair of said right-angled levers.

* * * * *

UNITED STATES PATENT AND TRADEMARK OFFICE

CERTIFICATE OF CORRECTION

PATENT NO. : 4,796,952

DATED : January 10, 1989

INVENTOR(S) : Giancarlo Piretti

It is certified that error appears in the above—identified patent and that said Letters Patent is hereby corrected as shown below:

Column 4, Line 29 Delete "rid" and substitute
--- rod ---

Signed and Sealed this

Twenty-fifth Day of July, 1989

*Attest:*

DONALD J. QUIGG

*Attesting Officer*

*Commissioner of Patents and Trademarks*

US004796952C1

(12) EX PARTE REEXAMINATION CERTIFICATE (6823rd)

United States Patent

Piretti

(10) Number: US 4,796,952 C1

(45) Certificate Issued: May 19, 2009

(54) CHAIR WITH HINGED BACKREST

(75) Inventor: Giancarlo Piretti, Bologna (IT)

(73) Assignee: Pro-Cord S.p.A., Bologna (IT)

Reexamination Request:
No. 90/008,295, Oct. 23, 2006

Reexamination Certificate for:

| | |
|---|---|
| Patent No.: | **4,796,952** |
| Issued: | **Jan. 10, 1989** |
| Appl. No.: | **07/050,862** |
| Filed: | **May 18, 1987** |

Certificate of Correction issued Jul. 25, 1989.

(30) Foreign Application Priority Data

Jun. 12, 1986 (IT) ..... 53523/86[U]

(51) Int. Cl.

| | |
|---|---|
| *A47C 1/031* | (2006.01) |
| *A47C 1/032* | (2006.01) |
| *A47C 3/20* | (2006.01) |

(52) U.S. Cl. ..... 297/300.5; 297/316; 297/340

(58) Field of Classification Search ..... None
See application file for complete search history.

(56) References Cited

U.S. PATENT DOCUMENTS

| | | | |
|---|---|---|---|
| 3,337,267 | A | 8/1967 | Rogers, Jr. |
| 4,479,679 | A | 10/1984 | Fries |
| 4,627,663 | A | 12/1986 | LaPointe |

*Primary Examiner*—Catherine S. Williams

(57) ABSTRACT

The chair is provided with a seat connected to a support structure of the chair by means of one or more hinged parallelograms consisting of pairs of tie-rods hinged to the seat and to the support structure. The structure of the chair backrest is integral with at least one of the tie-rods so as to allow the seat to be raised when the backrest is pushed backwards. Provision is also made for elastic means which are designed to counteract the backwards movement of the backrest.

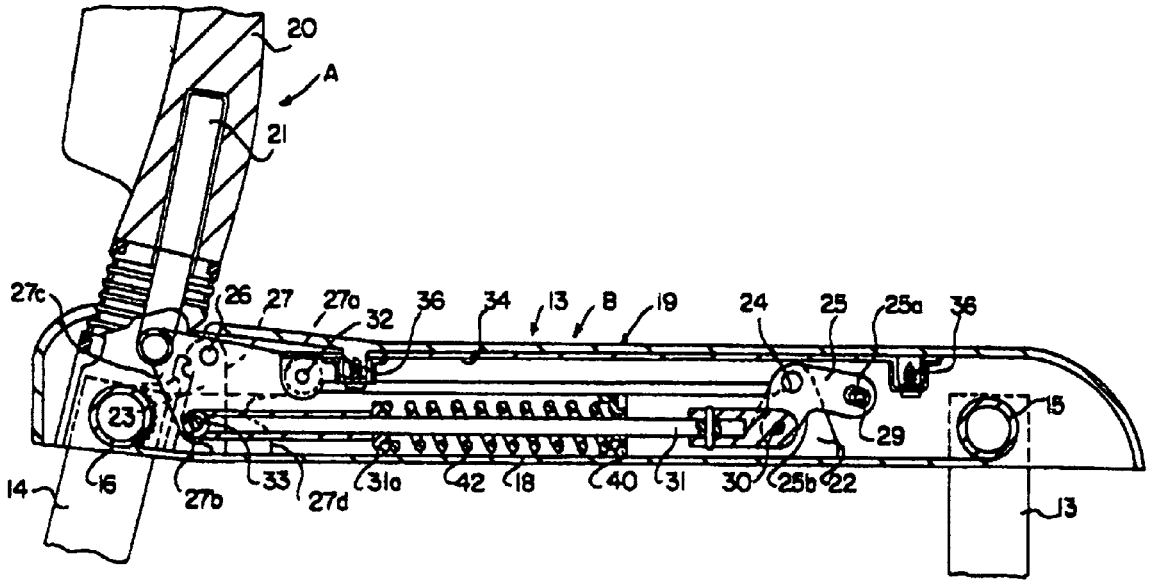

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claim 7 is cancelled.

Claims 1–6 and 8–13 were not reexamined.

* * * * *